US008028474B2

(12) United States Patent
Beck et al.

(10) Patent No.: US 8,028,474 B2
(45) Date of Patent: Oct. 4, 2011

(54) RAIN GUTTER DEBRIS PROPHYLACTIC

(76) Inventors: Brian M. Beck, Omaha, NE (US); David R. Herdrich, Omaha, NE (US); Lance D. Bailey, Omaha, NE (US); Randall R. Bailey, Omaha, NE (US)

( * ) Notice: Subject to any disclaimer, the term of this patent is extended or adjusted under 35 U.S.C. 154(b) by 0 days.

(21) Appl. No.: 11/627,317

(22) Filed: Jan. 25, 2007

(65) Prior Publication Data

US 2007/0199249 A1 Aug. 30, 2007

Related U.S. Application Data

(60) Provisional application No. 60/762,207, filed on Jan. 25, 2006.

(51) Int. Cl.
*E04D 13/00* (2006.01)

(52) U.S. Cl. ..... 52/12

(58) Field of Classification Search ..... 52/11, 12; 248/48.1, 48.2

See application file for complete search history.

(56) References Cited

U.S. PATENT DOCUMENTS

| | | | | |
|---|---|---|---|---|
| 4,796,390 | A | 1/1989 | Demartini | |
| 4,937,986 | A | 7/1990 | Way, Sr. et al. | |
| 5,010,696 | A * | 4/1991 | Knittel | 52/12 |
| 5,457,916 | A | 10/1995 | Tenute | |
| 5,557,891 | A | 9/1996 | Albracht | |
| 5,640,809 | A | 6/1997 | Iannelli | |
| 5,660,001 | A | 8/1997 | Albract | |
| 5,813,173 | A * | 9/1998 | Way, Sr. | 52/12 |
| 6,016,631 | A | 1/2000 | Lowrie, III | |
| 6,098,344 | A | 8/2000 | Albracht | |
| 6,151,836 | A | 11/2000 | McGlothlin et al. | |
| 6,151,837 | A * | 11/2000 | Ealer, Sr. | 52/12 |
| 6,412,228 | B1 | 7/2002 | Meckstroth | |
| 6,598,352 | B2 | 7/2003 | Higginbotham | |
| 6,701,674 | B1 * | 3/2004 | Albracht | 52/12 |
| 6,883,760 | B2 | 4/2005 | Seise, Jr. | |
| 7,104,012 | B1 * | 9/2006 | Bayram | 52/12 |
| 7,278,239 | B1 * | 10/2007 | West | 52/12 |
| D558,309 | S * | 12/2007 | Gregg | D23/267 |
| 7,448,167 | B2 * | 11/2008 | Bachman | 52/12 |
| 2005/0097826 | A1 | 5/2005 | Fox | |
| 2005/0166465 | A1 * | 8/2005 | Banks et al. | 52/11 |
| 2005/0172565 | A1 | 8/2005 | Riley et al. | |
| 2005/0193639 | A1 * | 9/2005 | Knudson et al. | 52/12 |
| 2005/0257432 | A1 | 11/2005 | Higginbotham | |
| 2006/0196124 | A1 * | 9/2006 | Bachman | 52/12 |
| 2006/0283097 | A1 * | 12/2006 | Gregg | 52/12 |

* cited by examiner

*Primary Examiner* — Brian Glessner
*Assistant Examiner* — Adriana Figueroa
(74) *Attorney, Agent, or Firm* — Dax D. Anderson; Kirton & McConkie

(57) ABSTRACT

The rain gutter debris prophylactic system has a first panel member and a second panel member joined by a trough with drains in the bottom. The trough helps regulate water flow, discourages water accumulation on the surface or the formation of icicles on the edge of the prophylactic. The front edge of the trough forms a water accelerator. In addition the drains formed in the trough allow the prophylactic to be bent by hand to match the angle formed between the roof and the gutter without heavy equipment such as hand brakes. Multiple sections may be bent simultaneously. Finally the system combines at least three water flow management techniques, namely a first set of drain holes, pooling ridges and a curved nose to conduct water over the edge of the gutter.

18 Claims, 7 Drawing Sheets

RAIN GUTTER DEBRIS PROPHYLACTIC

CLAIM OF PRIORITY

This application claims priority to U.S. Provisional Patent Application No. 60/762,207, filed Jan. 25, 2006.

BACKGROUND

1. Field of the Invention

The present invention relates to a system for straining debris from rain water. More particularly the present invention relates to a rain gutter shield having a plurality of water drains formed in the shield so as to permit rain water to flow into the gutter while simultaneously preventing most debris from entering the gutter.

2. Background of the Invention and Related Art

Many residential and commercial buildings utilize rain gutters as a means of channeling the flow of rain water. When properly functioning, rain gutters positioned on rooflines prevent erosion to both the ground and other surfaces, keep building patrons dry and also reduce the formation of ice in cold climates.

However rain gutters malfunction when filled with debris such as leaves, dirt and pine needles which are blown onto a roof. Such debris can accumulate in gutters to form dams within the rain gutter or a down spout. Such dams can cause water to pool and overflow the rain gutter. In addition the pooled water can freeze, thus adding substantial weight to the gutter. This additional weight can deform attachments and supports connecting the gutter to the building thus causing the gutter's grade to be significantly changed, thus allowing even more pooling. In addition the additional stress on the drain supports can cause the supports to pull away from the building, thus allowing water to enter, freeze and cause additional damage. Similar problems occur when the water in a downspout freezes.

Preventative measures have been utilized to help reduce the formation of dams and in turn building damage. One example is a rain gutter cover which provides a shield from the building roof-line's edge to the far edge of the gutter, thus shielding the gutter from debris flowing off the roof line. As a result rain gutter covers have been employed to reduce the accumulation of debris in the rain gutters. This is accomplished by channeling the debris across the length of the gutter and shedding the debris to the ground. Some of the water adheres to the surface of the shield through surface tension and drains into the gutter.

While many different rain gutter covers exist in the art, problems still exist. For example, use of a rain gutter cover promotes icicle formation on the shield during cold months. Similarly some rain gutter covers attempt to slow the water flow across the surface of the cover, thus promoting the accumulation of rain water on the surface of the gutter cover. Still other shields fail to function properly in anything other than optimal conditions.

Finally, installation of some rain gutter covers requires large equipment and tools such as a hand brake or siding brake to bend the rain gutter cover to match the angle between the roof pitch and the plane created by the rain gutter's top.

SUMMARY

Features of an exemplary embodiment include a system for straining debris from water flowing off a roof top by providing a trough with a plurality of drains, a nose forward and a plurality of pooling ridges which utilize water flow to force debris off the surface of the shield. The exemplary embodiments also provide a joint to make the system hand adjustable, or a tear-drop shaped fold to provide a water-dam hem.

SUMMARY OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE EXEMPLARY EMBODIMENTS

Figure 1:
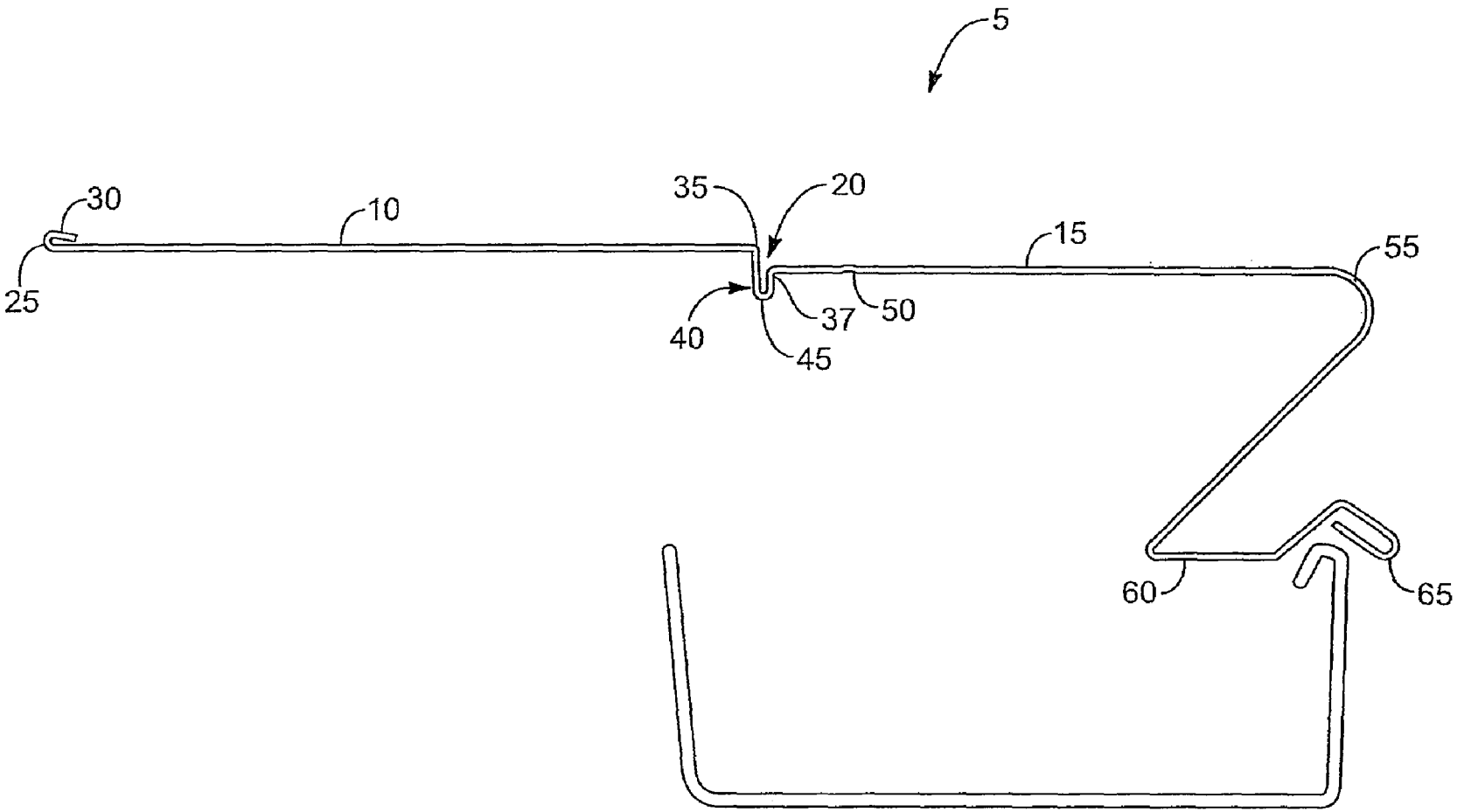
FIG. 1 illustrates a cross-view of an exemplary embodiment resting on a rain gutter.

This specification describes exemplary embodiments and applications of the invention. The invention, however, is not limited to these exemplary embodiments and applications or to the manner in which the exemplary embodiments and applications operate or are described herein.

The term water flow management system means a system for straining water flowing off a roof from debris which might accompany the water or which might otherwise be blown into the rain gutter. The system comprises three features which, presented sequentially in the order encountered by water flowing off a roof include: 1) perforated line weep holes running longitudinally across the system to control the volume of water flowing off the roof, the perforations providing drain holes into the gutter for water flowing off the roof, 2) at least one elevated ridge line positioned higher than the perforated line which causes pooling and 3) a curved nose extending in the direction of the flow of water.

The term gutter shield means a cover which reduces the amount of debris entering a rain gutter covered by the shield.

In certain exemplary embodiments, the term water trap, as used herein is a dual component system which comprises a first side wall which is a water accelerator 35, which accelerates water under the force of gravity and a second side wall 37 which is shorter than the first side wall, the second side wall 37 forms a dam. The first 35 and second 37 side walls of the water trap may be substantially planar and are conjoined by a trough having a plurality of drains in the bottom of the trough, the aperture size of the drains is selected based on balancing the need to prevent ice from forming on in the trap, and the need to simultaneously allow water to pool in the trough during rain storms. The combination of acceleration and pooling acts to flush the debris from the trap. The water trap may be formed in the shape of a "U", "J" or "T" creating a sunken channel. The water trap as illustrated at reference numbers 20, 21, and 22, is a water accelerator means.

The term trough means the channel formed by the water trap.

The term water-pooling ridge is a dam running longitudinally the length of the shield.

The term nose is a curvature forming the most extreme boundary of the shield, the radius of curvature being small enough to allow water to flow along the surface and great enough to shed any debris flowing therein.

The term water accelerator is a surface feature of the water trap which increases the water flow velocity by gravity. The water accelerator also promotes the advancement of debris across the shield to be discarded beyond the edge of the nose by flushing the water trap. The water accelerator accelerates the flow rate of water by increasing the angle of the flow surface in the vertical direction as relative to the surface angle of the first panel. The water accelerator is sometimes called a "self-cleaning" water accelerator.

The term "hand adjustable" or "hand manipulable" means the angle at which the shield may be bent or may be manipulated or adjusted by hand so as to conform to the angle formed by the pitch of the roof and the plane created by the top of the rain gutter.

The term hem is a water dam.

A first exemplary embodiment of the present water flow management system, illustrated in FIG. 1, is a gutter shield having a first panel member 10 and a second panel member 15. The two panel members are joined along a water trap 20. In the exemplary embodiment of FIG. 1, the water trap 20 has vertically offset sides so that first panel member 10 resides in a vertically higher plane than panel member 15. The exemplary embodiment further comprises a nose 55, a drain 60, and a coupling lip 65.

The upper panel member 10 further comprises an extreme upper edge 25, which can be curled over to create a hem 30. The hem 30, as illustrated in FIG. 1, functions to prevent water climbing up panel member 10 by capillary action from going beyond the extreme upper edge 25 of the first panel member 10. Furthermore, the hem 30 acts as a wedge such that when utilized, the exemplary embodiment of FIG. 1 can be positioned beneath shingles on a roof and the wedge shape of the hem 30 prevents the gutter shield 5 from moving and prevents water from seeping under the shingles. The wedge shape of the hem 30, being curled up and away from the roof surface also prevents the upper panel 10 from catching on the roof, tar paper, nail heads or any other structure situated between the roof top and the shingles, thus allowing for smooth ingress of the upper panel member into the space between the shingles and the roof.

At the lower end of the first panel member, where the first panel member 10 joins the water trap 20, a curvature is formed, which constitutes a water accelerator 35. The water accelerator 35 acts as a self-cleaning mechanism by increasing the flow rate of water moving across first panel member 10 into, through, or over water trap 20 and across second panel member 15. Thus, any debris carried by the water moving across the gutter shield 5 is pushed more effectively by the higher rate of water flow as caused by the water accelerator 35.

In addition, the water accelerator 35 feeds into a trough 40 which allows water flowing across the gutter shield 5 to seep or drain through perforation drains 45 along a lower portion of the channel formed through 40. The perforation drains 45 comprise a series or plurality of drain holes formed through the surface of the water trap 20. The perforation drains are located primarily along the bottom of the trough 40 and extend below accelerator 35 of the water trap so that water flowing across the water accelerator 35 and down into the water trap encounters drain holes 45 and any water accumulating in the water trap 20 is dammed up by the lower side 37 of the water trap, thus forcing water to flow through the drain holes 45 of the water trap 20.

Water trap 20 provides additional advantages. Specifically, the water volume and flow rate is controlled by water trap 20, thus reducing the formation of icicles in the winter time. In addition, flow control is accomplished by creation of a small pool in the water trap. When debris flows across the first panel member 10 and encounters the water trap 20, the debris will begin to float across the water trap and down onto the second panel member 15. As this occurs, water and debris begin to separate, thus reducing the amount of water going over the nose 55 and further reducing the amount of excess water running beyond the rain gutter (not shown). Additionally, the water trap 20 with the drain holes 45 therein may prevent water from pooling on upper panel 10 and back flowing beyond the hem 30 the roof beneath the shingles.

The system illustrated in this exemplary embodiment further takes advantage of flow rates by providing at least one pooling ridge 50 located on the upper surface of second panel member 15. By providing pools on the surface of the second panel member, debris continues to move along the surface of the second panel member 15 to the edge of the nose 55, where debris falls to the ground and water follows the surface of the nose into the drains 60 below. Alternative embodiments may comprise at least three pooling ridges, which aid in the shedding of debris as described above.

Finally, a coupling lip 65 is provided at the lower end of the gutter shield 5. The coupling lip 65 is manipulated to fit on the brim or upper edge of any rain gutter and can be attached byscrews or other means commonly employed in the art. As illustrated in the exemplary embodiment of FIG. 1, the coupling lip extends slightly beyond the edge of the nose. However, the trough formed by the lower drains 60 does not extend beyond the edge of the nose. This placement encourages debris to fall to the ground without entering the drains 60. A securing means, such as a screw or clip is used to couple the coupling lip 65 to the gutter 85. Also may include recessed pilot holes that allow attachment screws to be obscured from view and avoid debris collection.

Alternative embodiments of the gutter shield 5 may be made of aluminum, painted aluminum, vinyl, plastics, steel, copper, and other materials commonly known in the art. In addition, the surface of alternative embodiments may be textured so as to increase whetting of water on the surface, change flow rates of water across the surface of the gutter shield 5, or to provide micro-channels for water across either the first panel member 10 or the second panel member 15.

Figure 2:
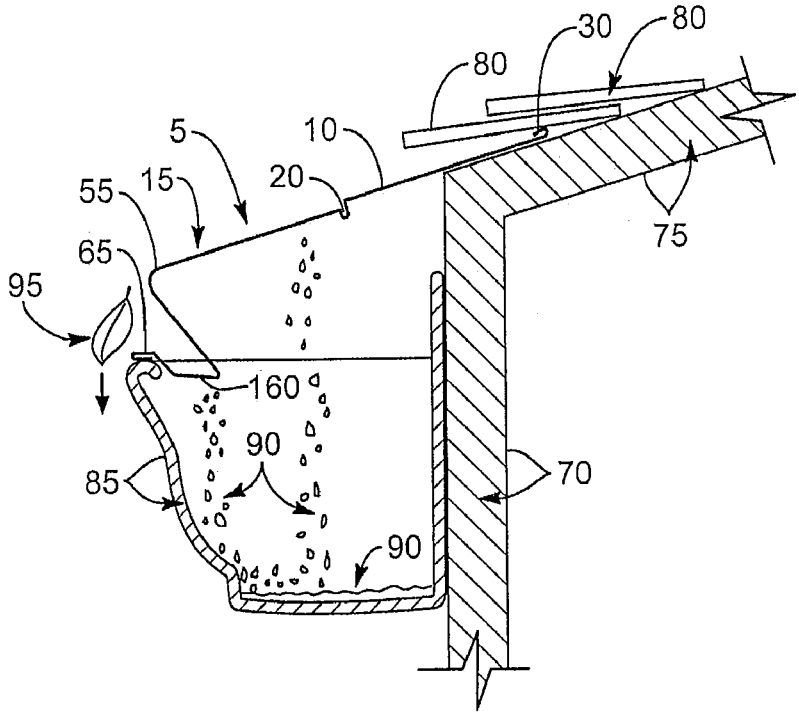
FIG. 2 illustrates a cross view of an exemplary embodiment operating on a roofline.

Referring now to the exemplary embodiment illustrated in FIG. 2, a building 70, such as a residential building or commercial structure, having a roof 75 with shingles 80 mounted thereon. The building 70 further has a rain gutter 85 attached to the side of the building 70 such that rain water flowing off the surface of the shingles 80 deposits in the rain gutter 85. The exemplary embodiment of FIG. 2 further comprises a gutter shield 5 having the hem 30 wedged underneath the shingle 80, as illustrated. In addition, the coupling lip 65 is coupled to the brim or edge of the rain gutter 85. Thus FIG. 2 illustrates an exemplary embodiment of a gutter shield installed in one particular method.

Further illustrated in FIG. 2 is the sources of water flowing. Water flows through the water trap 20 and through drains 60. In addition, debris 95, illustrated in FIG. 2 as a leaf, is dropping beyond the edge of the nose 55, and beyond reach of the rain gutter 85.

Figure 3:
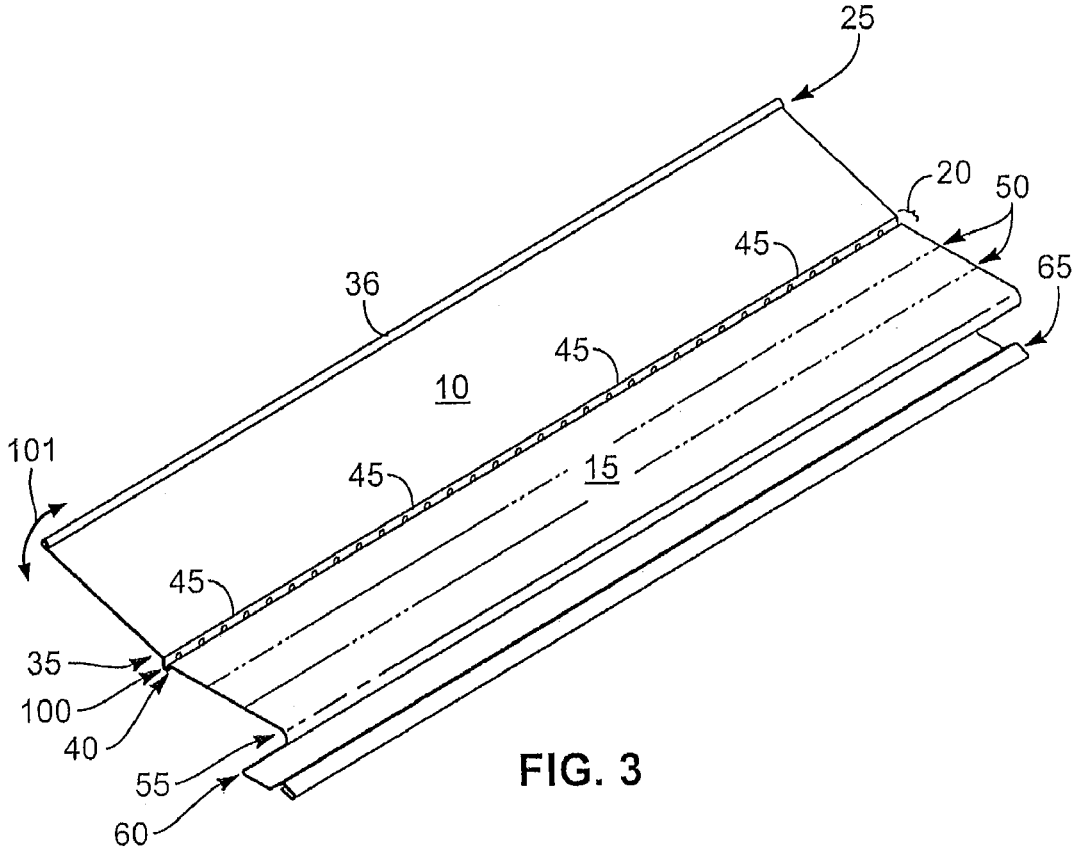
FIG. 3 illustrates a perspective view of an exemplary embodiment as it is manipulated.

An alternative light weight metal or plastic embodiment of the present invention is illustrated in FIG. 3. FIG. 3 provides a hand adjustable hinge or joint 100. Hinge 100 is formed by the weakening or perforating along a line near or at the perforations drain holes 45. Arrow 101 illustrates the direction which the first panel member 10 can be adjusted to match the pitch of the roof to which the gutter shield 5 is being applied. Thus, a practitioner of the exemplary embodiment illustrated in FIG. 3 can adjust the angle formed between the first panel member 10 and the second panel member 15 using his hands only. Multiple sections may be bent simultaneously. Alternatively, as is commonly done in the art hand brakes and other similar sheet bending tools are employed to adjust the angle between the first panel member 10 and second panel member 15. This hand adjustable feature of the exemplary embodiment illustrated in FIG. 3 significantly reduces the amount of time required to install a gutter shield 5, as well as improves the safety for the practitioner installing gutter shield 5 by not requiring strenuous attempts to bend the members without a tool while standing on a ladder where a tool is intended to be used.

Figure 4:
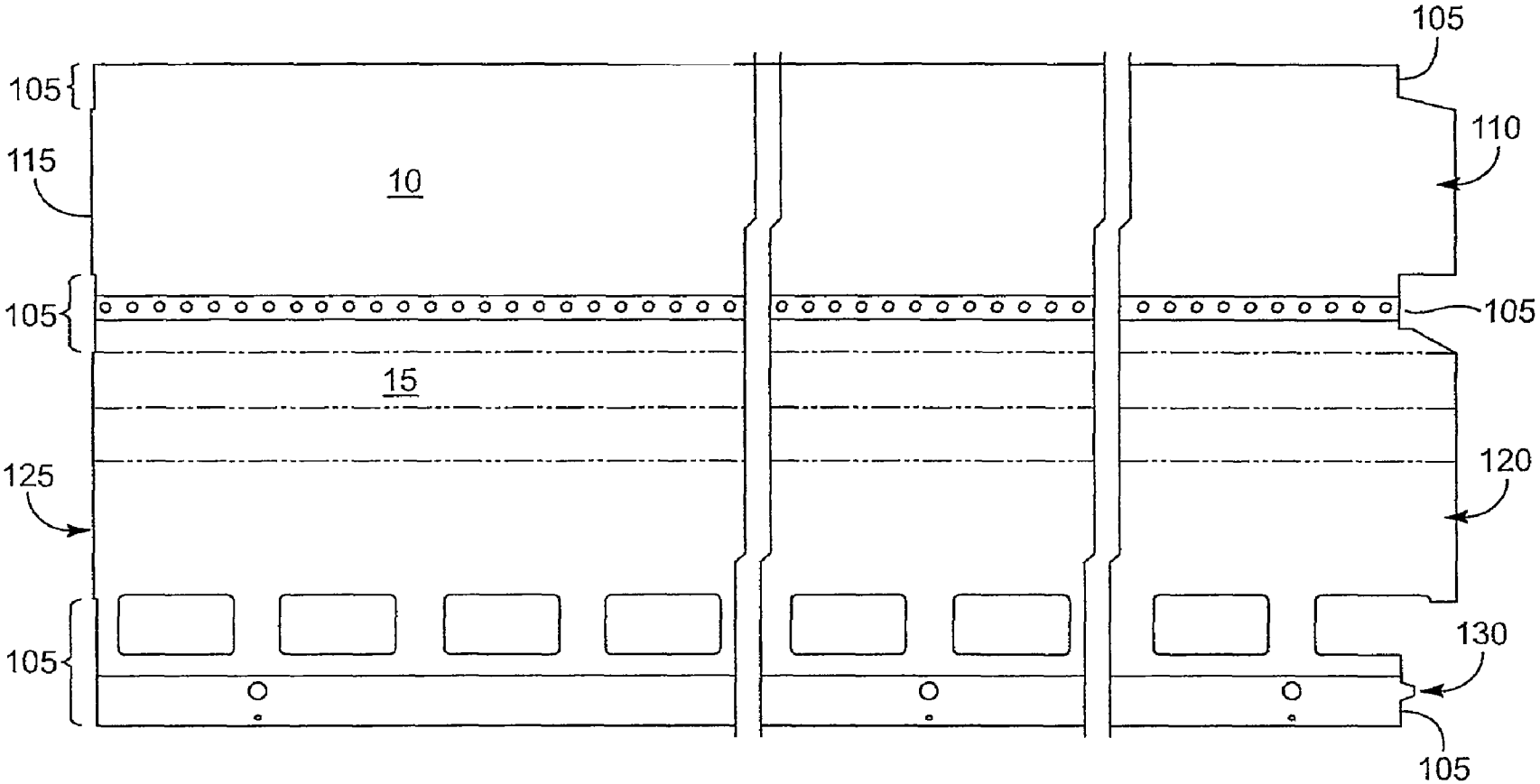
FIG. 4 illustrates a detailed plan view of an exemplary embodiment.
Figure 5:
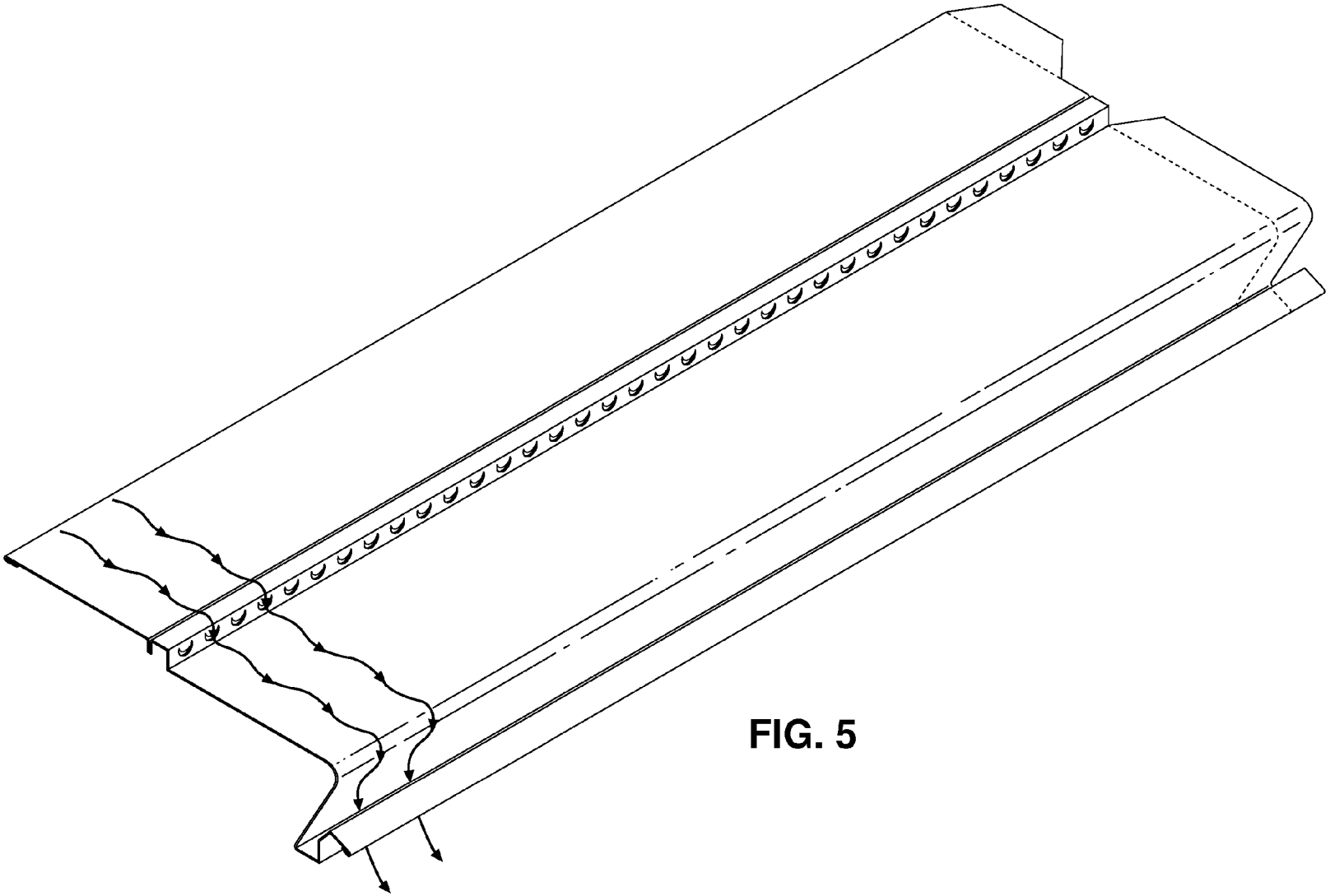
FIG. 5 illustrates an alternative exemplary embodiment wherein the drain holes are half moon louvers.
Figure 6:
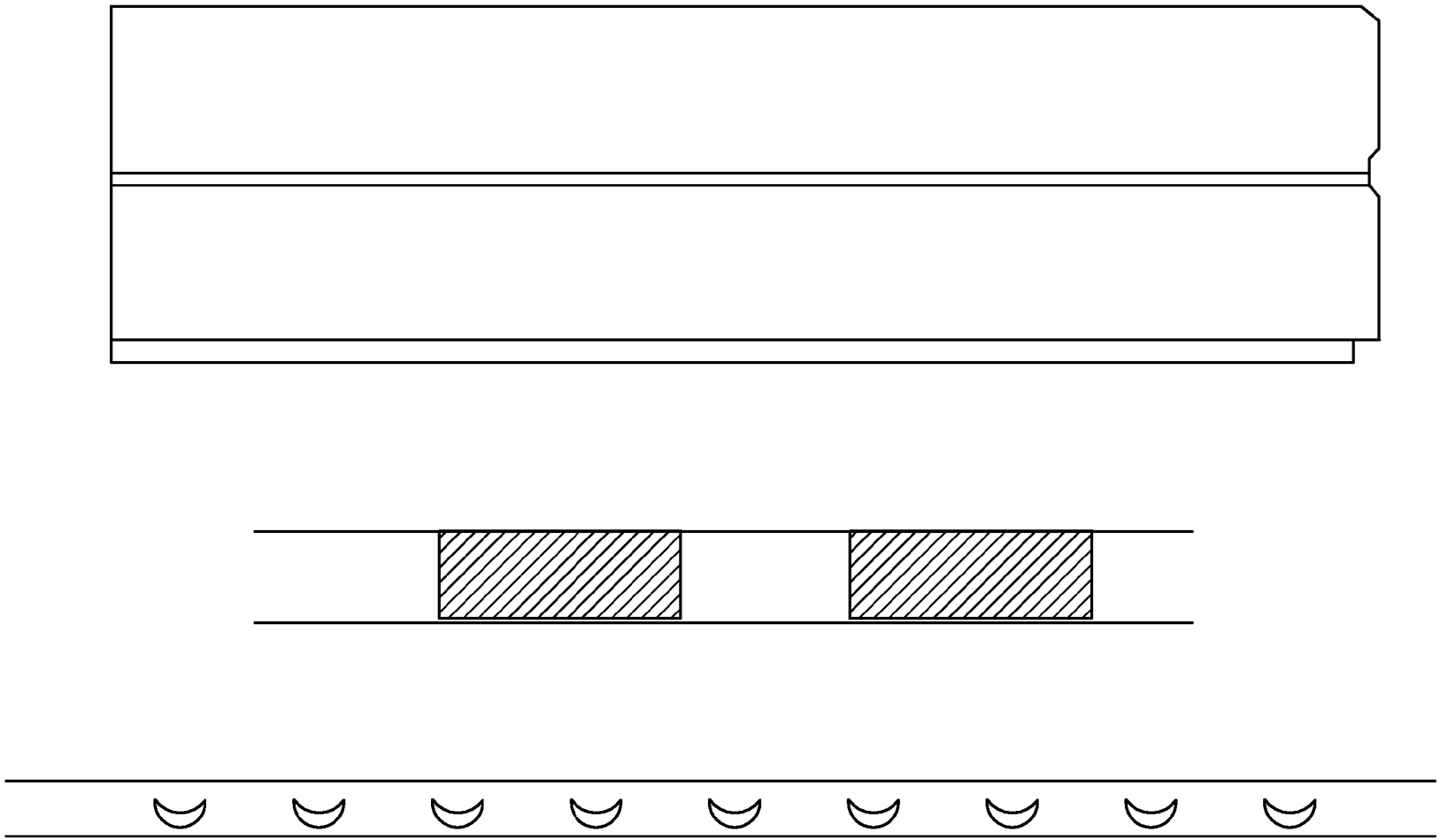
FIG. 6 illustrates a top view of an alternative exemplary embodiment.
Figure 7:
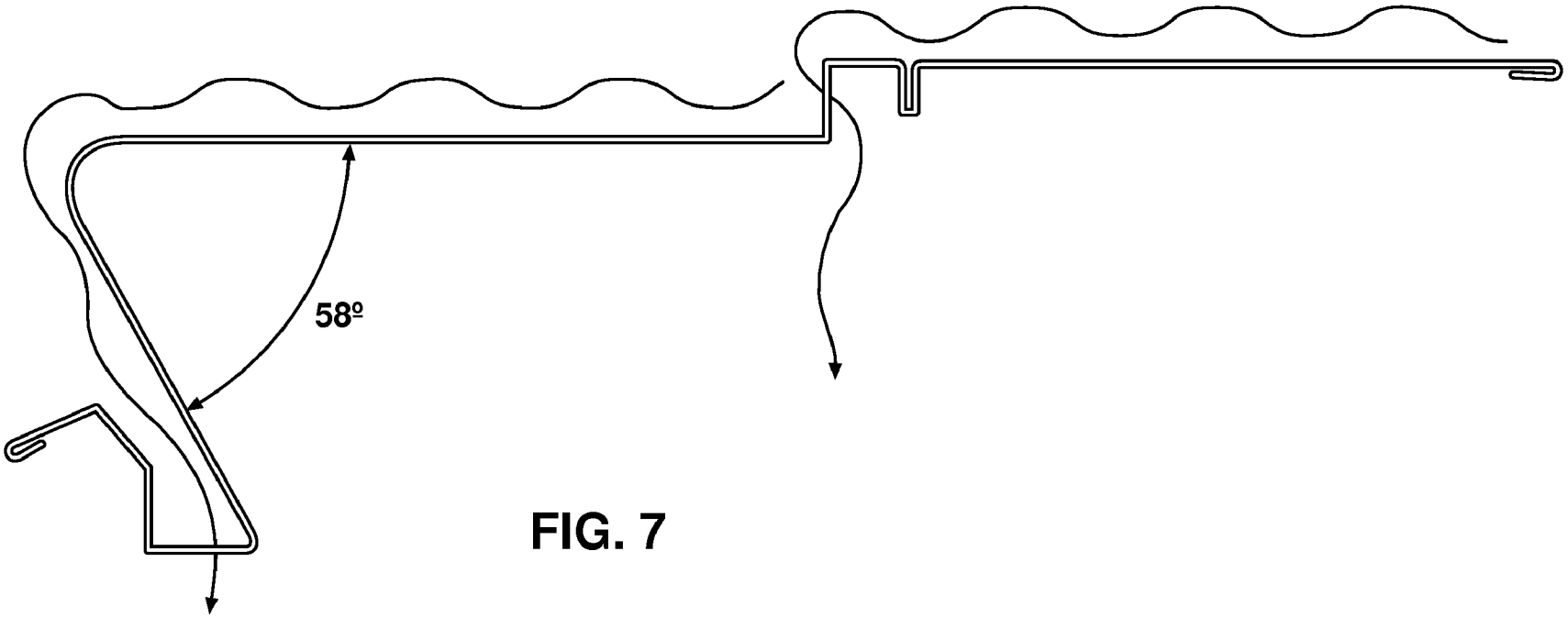
FIG. 7 illustrates a perspective view of an alternative exemplary embodiment illustrating the louvers.
Figure 8A:
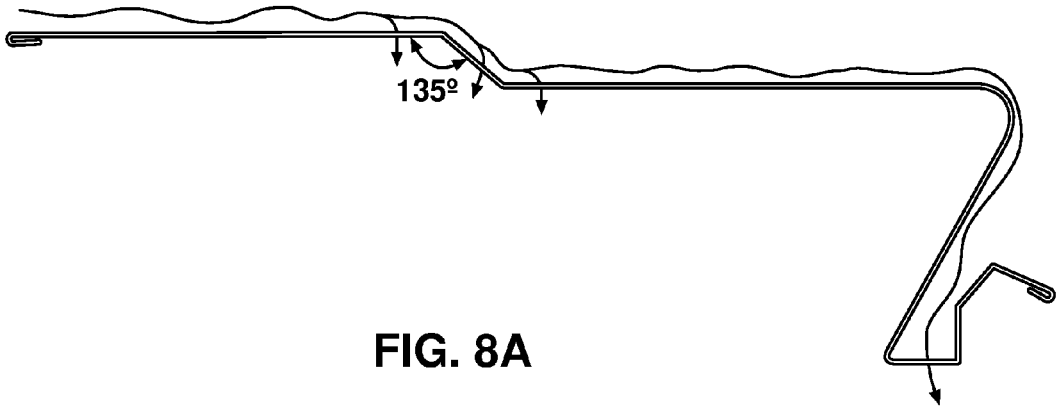
FIG. 8*a* illustrates a cross-sectional view of an alternative exemplary embodiment having an water accelerator.
Figure 8B:
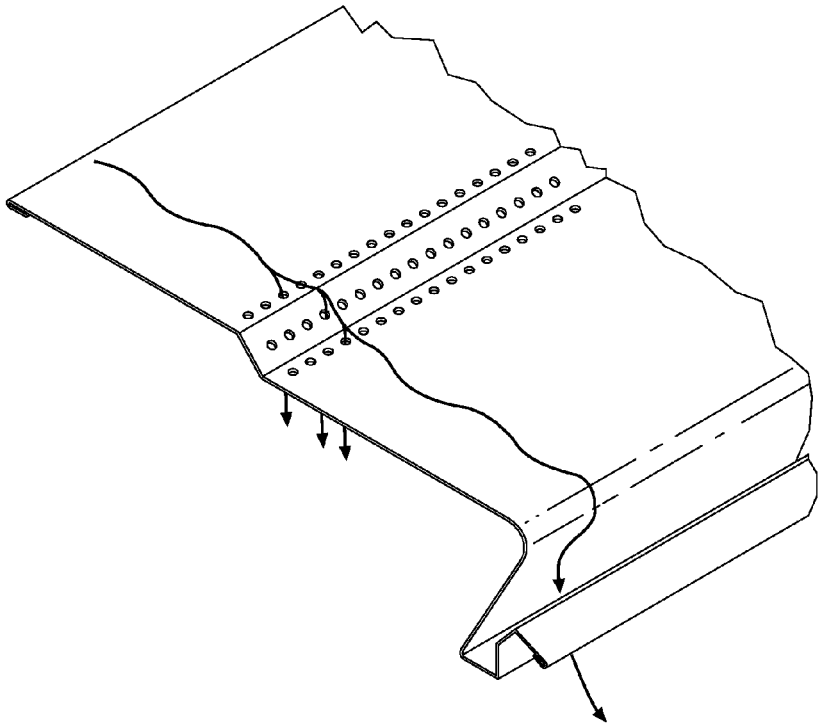
FIG. 8*b* illustrates a perspective of an alternative exemplary embodiment.

An alternative exemplary embodiment is illustrated in plain view in FIG. 4, wherein is illustrated one complete section of a shield panel which can be mated or butted up against similar panels to form a continuous gutter shield. The contact surface 105 is where the two panels coupled together would actually meet or lie adjacent. However, a first panel mating tab 110 is formed to create significant overlap between two adjacent panel members. A screw or adhesive may be used to secure one section of panel to a second section of panel if desired. A friction fit may be enough. When the exemplary embodiment illustrated in FIG. 4 is used as intended, the first panel mating tab 110 will be inserted below a first panel short tab 115. Thus, the extended tab will be disposed beneath the adjoining panel section and reduce obstructions on which debris might be caught. A similar configuration is illustrated for the second panel member wherein a second panel member mating tab 120 is illustrated and a second panel member short tab 125 is also illustrated. The second panel member 120 over short tab 125. In addition, a mating tooth 130 is provided on the coupling lip 65 to help align one section of panel with a second section of panel. These mating configurations are applicable to all embodiments in FIGS. 1-4.

Additionally the present exemplary embodiment shows recessed screw hole 66 and pilot hole 67 which align when the exemplary embodiment shown in FIG. 4 is bent to the proper configuration as shown in FIGS. 1-3. The recessed screw hole 66 allows the screw head (not shown) to lie flush with the surface of the coupling lip 65, thus reducing surfaces upon which debris can be caught. Additionally pilot hole 67 aids the installer in placing the screws, as well as improves the installation conformity. For example, the distributor is able to clearly instruct all potential installers as to the frequency and spacing of the screws.

What is claimed is:

1. A water flow management system comprising: a rain gutter shield comprising a first panel and a second panel, the first and second panels having no holes therein;

a water trap joining the first panel member and the second panel member, the water trap comprising a first side wall and a substantially planar second side wall which is shorter than the first side wall, the two side walls being joined by a trough, said first and second side walls being substantially perpendicular to the second panel, the trough further comprising a plurality of drain holes formed in the trough;

at least one water pooling ridge on the a top surface of the second panel;

a nose formed downstream from the trough on the second panel;

a drain joining the nose and a coupling lip.

2. The system of claim 1 wherein the water trap further comprises a planar first side wall joined to the first panel member and the second side wall joined to the second panel member, the first side wall being vertically offset from the second side wall such that the first side wall is in a vertically higher position as compared to the second side wall.

3. The water flow management system of claim 1 wherein the first side wall extends from the first panel to create an angle between the first side wall and the first panel member of at least 70 degrees.

4. The water flow management system of claim 1 wherein the first side wall comprises a water accelerator.

5. The water flow management system of claim 1 wherein the drain holes are circular.

6. The water flow management system of claim 1 wherein the drain holes are half-moon shaped.

7. The water flow management system of claim 1 wherein the drain holes further comprise a louver positioned on one side of the drain hole.

8. The water flow management system of claim 1 further comprising water pooling reduction drain holes.

9. The water flow management system of claim 1 wherein the angle between the first panel member and the second panel member is hand adjustable.

10. The water flow management system of claim 1 further comprising a water damming hem on the edge of the first panel member.

11. The water flow management system of claim 1 wherein the drain holes sufficiently reduce the system's rigidity so as to permit hand adjustment of the angle between the first panel member and the second panel member.

12. A rain gutter shield comprising: a first panel member and a second panel member joined to the first panel by a water trap further comprising substantially planar walls; the first and second panels having no holes therein; the second panel being in a vertically lower position as compared to the first panel member; the water trap forming a hand adjustable joint, said first and second side walls being substantially perpendicular to the second panel;

a nose extending from the second panel;

a drain joining the nose and a coupling lip.

13. The rain gutter shield of claim 12 wherein the first panel member further comprises a water-damming hem formed on an edge of the first panel, the hem forming a wedge.

14. The system of claim 1 wherein the water trap is formed from a j-bend.

15. The water flow management system of claim 1 further comprising a self-cleaning water accelerator.

16. A water flow management system comprising: a rain gutter shield comprising a first panel and a second panel;

a water trap joining the first panel member and the second panel member, the water trap comprising a first side wall and a substantially planar second side wall which is shorter than the first side wall, the two side walls being substantially vertical, the second side wall being substantially orthogonal to the second panel;

the two side walls being joined by a trough, the trough further comprising a plurality of drain holes formed in the trough;

at least one water pooling ridge on a top surface of the second panel;

a nose formed downstream from the trough on the second panel;

a drain joining the nose and a coupling lip.

17. The system of claim 16 wherein the water trap further comprises a planar first side wall joined to the first panel member and the second side wall joined to the second panel member, the first side wall being vertically offset from the second side wall such that the first side wall is in a vertically higher position as compared to the second side wall.

18. The system of claim 16 wherein the first and second panels have no holes therein.

* * * * *